US005630439A

United States Patent [19]

Hutto

[11] Patent Number: 5,630,439

[45] Date of Patent: May 20, 1997

[54] PORTABLE HUT

[76] Inventor: Eddy H. Hutto, P.O. Box 151, Clara, Miss. 39324

[21] Appl. No.: 667,233

[22] Filed: Jun. 19, 1996

[51] Int. Cl.[6] ..... E04H 15/04

[52] U.S. Cl. ..... 135/90; 135/96; 135/901

[58] Field of Search ..... 135/90, 900, 901, 135/96, 115; 43/1

[56] References Cited

U.S. PATENT DOCUMENTS

| | | | |
|---|---|---|---|
| 2,570,361 | 10/1951 | Mejia | 135/96 X |
| 3,116,808 | 1/1964 | Riley | 135/90 X |
| 3,690,334 | 9/1972 | Miller | 135/1 R |
| 4,505,286 | 3/1985 | Madion | 135/90 |
| 4,739,785 | 4/1988 | Poulson | 135/900 X |
| 4,805,655 | 2/1989 | Justice | 135/90 |
| 4,813,441 | 3/1989 | Kepley | 135/90 |
| 4,825,484 | 5/1989 | Riegel | 135/96 X |
| 4,825,578 | 5/1989 | Robinson | 43/1 |
| 4,951,696 | 8/1990 | Jones, Sr. | 135/90 |

*Primary Examiner*—Lanna Mai

*Attorney, Agent, or Firm*—Patent & Trademark Services; Joseph H. McGlynn; Thomas Zack

[57] ABSTRACT

A portable hut having a collapsible supporting frame and an outer fabric covering. A strap uses a hook and loop fastener to hold it to a bracket that engages a frame connector. When engaged, the bracket and connector may vertically support the hut on a tree. If desired, the hut may be mounted on a hunter's deer stand to increase its above ground disposition.

5 Claims, 1 Drawing Sheet

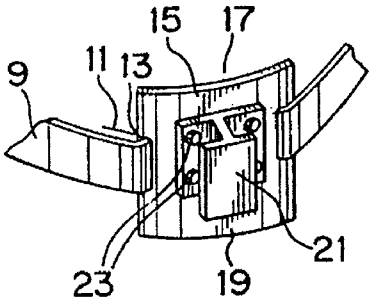
FIG. 2
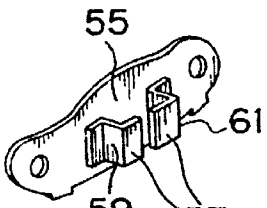
FIG. 5
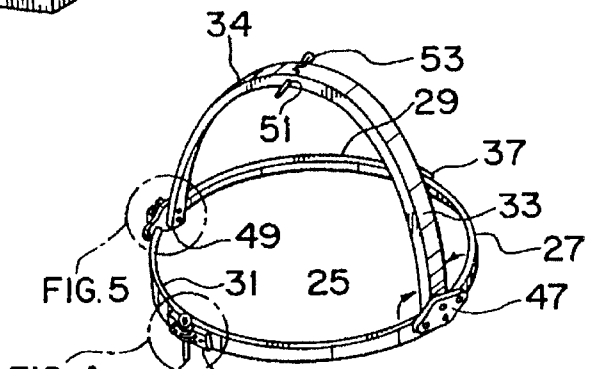
FIG. 3
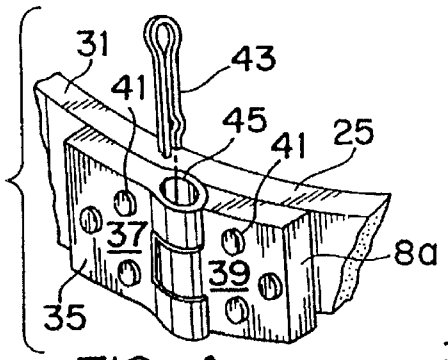
FIG. 4
FIG. 5
FIG. 4
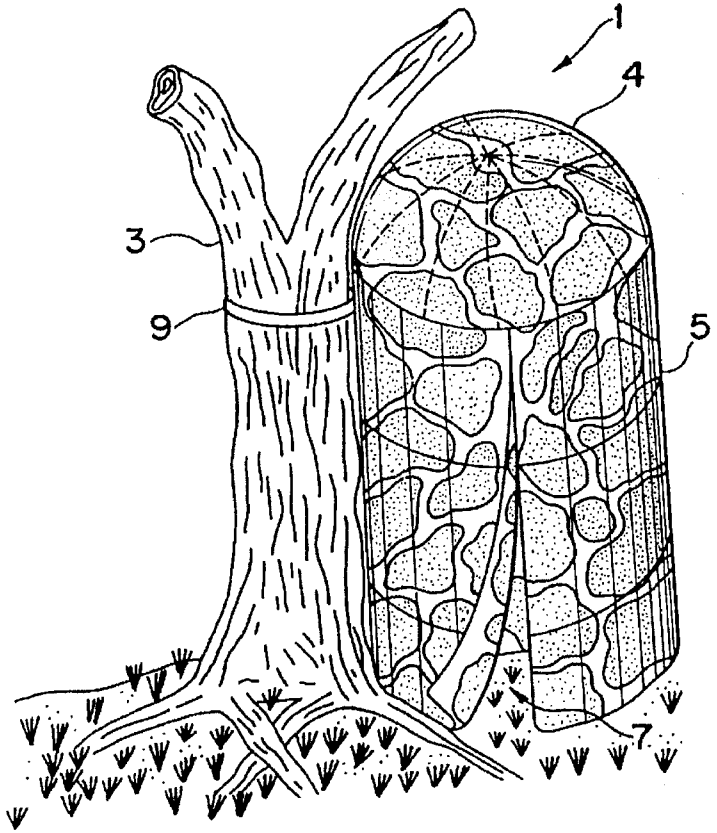
FIG. 1

PORTABLE HUT

BACKGROUND OF THE INVENTION

The present invention relates to a compact camouflage hut which can be mounted to a tree. A strap with a hook and loop fastener holds a bracket to the tree. Attached to the bracket by an interlocking connector is the hut's frame. A water repellent fabric covers the frame to allow its use by hunters and sportsman. The hut may be installed at ground level or used in conjunction with a standard deer stand.

DESCRIPTION OF THE PRIOR ART

In the prior art various types of compact outdoor structures are known. For example, the Miller reference (U.S. Pat. No. 3,690,334) discloses a hunting blind having a framework made up of interconnecting rod like members over which a housing can be placed. In the Madion U.S. Pat. No. 4,505,286, the shelter is strapped to a tree. The Robinson invention (U.S. Pat. No. 4,825,578) has a collapsible blind suspended from a tree limb. And in the Jones (U.S. Pat. No. 4,951,696) structure support is provided by a chain and tree engaging spike members. None, however, disclose a tree supported bracket which supports a frame structure covered by a camouflaged material as disclosed herein.

SUMMARY OF THE INVENTION

The present invention consists of hut supported to a tree. A strap engages the tree and has a bracket used to connect and support it to an overhead frame structure. The frame is made up of several interconnected collapsible section parts. Camouflaged material having an opening covers the frame and may extend to the ground.

It is an object of the present invention to provide an improved portable outdoor hut.

It is a further object of the present invention to provide such a hut which is mounted to a tree.

It is still another object to provide a hut have a collapsible support frame structure.

These and other objects and advantages of the present invention will be fully apparent from the following description, when taken in connection with the annexed drawings.

BRIEF DESCRIPTION OF THE DRAWINGS

FIG. 1 shows the assembled preferred embodiment of the present invention mounted to a tree.

FIG. 2 is an enlarged view of the preferred embodiment's bracket.

FIG. 3 depicts the assembled support frame structure.

FIG. 4 illustrates an enlarged view of the frame's hinged connection.

FIG. 5 shows the frame's bracket engaging connector.

DESCRIPTION OF THE PREFERRED EMBODIMENT

Referring now to the drawings in greater detail, FIG. 1 shows the present invention's assembled preferred embodiment 1 mounted to a tree 3. Extending from an internal frame structure is the fabric covering 5 having an opening flap 7 to allow exiting and entering. A strap 9 encircles the tree and has a hook and loop (or VELCRO™) fastener 11 at one end as shown in the enlarged FIG. 2 view. The strap's free end fits through a vertical slotted hole 13 in the metal bracket 15 and terminates in the loop and hook closure. The strap's other end is fixed to the same bracket such that by pulling on the free end the strap can be tighten and then fixed around the tree. On its back side 17 the bracket fits against the tree while its front side 19 has an attached extending male bracket extender 21 resembling a vertical I beam. This extender may be tapered such that its upper portion is slightly narrower than its bottom portion. Four spaced rivets 23 mount the extender to its bracket.

FIG. 3 depicts the assembled support frame structure over which the fabric 5 is placed. The frame consists of three horizontally disposed and interconnected curved sections 25, 27, 29 and 31; and a connected central curved upper vertical support rod made up of two sections 33 and 34. The four horizontal sections form a circle when viewed from above. Diagonally across from each other are two identical swivel hinge connections 35 and 37. As best shown in FIG. 4, each hinge connection is made up of two components 37 and 39 connected to two interfacing frame sections by several rivets 41. A cotter type securing pin 43 extends into a vertical hole 45 to join the two adjoining frame sections 25 and 31 together. The identical type hinge connection 37 joins the two frame sections 27 and 29 together in the same way. Joining the other ends of frame sections 25 and 27 to the vertical frame section member 33 is a hinged tri-axial connector 47. Opposite therefrom on the circles other side is a similar tri-axial connector 49 which joins the two horizontal frame sections 29 and 31 to each other and the vertical section 34. At their interlocking zenith interface 51 the two curved joined frame sections 33 and 34 are joined together by a cotter type securing pin 53 which extends through a horizontal hole (not shown) in both sections ends.

FIG. 5 is an enlarged view of one of the rivet mounted bracket 55 having a female type slotted connector 57 fixed to it. This connector extends outward from the circle formed by the four frame sections members and has two separate three sided legs 59 and 61. These legs are shaped and sized to slidably engage the I beam shaped male extender 21 by sliding down into them. By providing less taper to the connector's legs than the extender 21, the connector binds when slides down on the extender and is prevented it from falling through it. This assures a firm hold between the extender and connector. Alternately, an internal stop (not shown) in the extender's I beam slot could be used to prevent the legs 59 and 61 from falling through and act to vertically support the frame connection.

The covering 5 used to cover the assembled frame can be attached to the frame with internal spaced ties and is made of a water repellent fabric such as Gore-Tex™ or the like material. Preferably its outer surface is camouflaged to blend in with the local environment.

The vertical frame sections 33 and 34 may be folded either to the left or right (see arrows in FIG. 3) to align it with the horizontal frame sections. For storage and disassembly, the pin 53 may be removed to separate the two vertical sections as well as the two pins holding the horizontal sections together. With these pins removed, the frame sections can be folded on each other for easy transport and storage.

The main hinge and connector components would be best manufactured using the metal stamping process. Metal stamping is a process whereby flat metal is formed between two parts of a die under tremendous pressure. The metal is punched, formed and shaped to these dies, many times in one process, many times spot welding of separate components is employed to complete the assembly of sheet metal components. The stamped metal may be stainless steel or plated carbon steel to prevent rusting.

The flat support frame sections for the folding frame are best manufactured using the metal extrusion process. The metal extrusion process is one whereby molten, heat softened metal is forced under high pressure through a die, similar to toothpaste being squeezed through the hole in the tube, (in this example the hole in the tube is the die). The metal forms a continuous length in the shape of the die it was squeezed through. In other words the metal would come out continually in the shape of a rod using the nozzle of the toothpaste tube as a die, but would come out in the shape of a square if the die were square. In this case the metal extrusion would take on the shape of the frame section members. Many familiar parts you deal with on a weekly basis were more than likely extruded. Metal rods, bars, and flats and similar items are all manufactured using the extrusion process.

The webbing and camouflage material are available as off the self components which are assembled using conventional "knitting" and sewing techniques.

Although the described hut and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A portable hut comprising:

a fabric material;

a frame structure over which said fabric can be mounted, said frame having vertical and horizontal disposed interconnected members, said vertical members being connected to the horizontal members by foldable connections;

an elongated flexible strap assembly with a connected bracket, said bracket having an extending portion;

a receiving connector on said frame shaped and sized to receive and hold said bracket's extending portion whereby the frame structure may be vertically supported above ground when said strap is tighten around a tree.

2. The invention as claimed in claim 1, wherein said horizontal and vertical members are held to their adjoining members by interlocking pins inserted into holes in the members.

3. The invention as claimed in claim 2, wherein said strap assembly has a hook and loop fastener at one of its ends to hold the connected bracket around a tree.

4. The invention as claimed in claim 3, wherein said bracket's extended portion is shaped to resemble a vertical I beam on which the complementary shaped frame connector slides.

5. The invention as claimed in claim 4, wherein said bracket's extended portion is shaped to prevent the complementary shaped frame connector from sliding completely through it.

* * * * *